US008881330B2

(12) United States Patent
Ghosh et al.

(10) Patent No.: US 8,881,330 B2
(45) Date of Patent: Nov. 11, 2014

(54) METHOD OF OPERATING A LAUNDRY TREATING APPLIANCE

(75) Inventors: Kaustav Ghosh, Saint Joseph, MI (US); Thomas A. Latack, Baroda, MI (US); Robert J. Pinkowski, Baroda, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1002 days.

(21) Appl. No.: 12/967,517

(22) Filed: Dec. 14, 2010

(65) Prior Publication Data

US 2012/0144601 A1 Jun. 14, 2012

(51) Int. Cl.

| | |
|---|---|
| ***D06F 35/00*** | (2006.01) |
| ***D06F 33/02*** | (2006.01) |
| ***D06F 25/00*** | (2006.01) |

(52) U.S. Cl.

CPC ..... *D06F 25/00* (2013.01); *D06F 35/006* (2013.01); *D06F 33/02* (2013.01)

USPC ..... 8/158; 8/159

(58) Field of Classification Search

CPC ..... D06F 35/006

See application file for complete search history.

(56) References Cited

U.S. PATENT DOCUMENTS

| | | | |
|---|---|---|---|
| 3,872,604 | A | 3/1975 | Keller |
| 7,594,343 | B2 | 9/2009 | Woerdehoff et al. |
| 2009/0071032 | A1 | 3/2009 | Kreutzfeldt et al. |
| 2009/0083988 | A1 | 4/2009 | Yoon et al. |
| 2009/0126222 | A1 | 5/2009 | Bae et al. |
| 2009/0178295 | A1 | 7/2009 | He et al. |
| 2009/0211109 | A1 | 8/2009 | Choi et al. |

FOREIGN PATENT DOCUMENTS

| | | | |
|---|---|---|---|
| WO | 2007/137857 | A1 | 12/2007 |

*Primary Examiner* — Jason Ko

(57) ABSTRACT

A method for treating laundry in a clothes dryer having a rotating drum defining a treatment chamber that includes applying a treating chemistry.

20 Claims, 5 Drawing Sheets

METHOD OF OPERATING A LAUNDRY TREATING APPLIANCE

BACKGROUND OF THE INVENTION

Laundry treating appliances, such as clothes washers, clothes dryers, and refreshers, may have a configuration based on a rotating drum that defines a treating chamber in which laundry items are placed for treating according to a cycle of operation. A dispensing system may be provided for dispensing a treating chemistry as part of the cycle of operation. A controller may be operably connected with the dispensing system and may have various components of the laundry treating appliance to execute the cycle of operation. The cycle of operation may be selected manually by the user or automatically based on one or more conditions determined by the controller.

To date, most commercially available, household laundry treating appliances with a dispensing system have primarily been clothes washers, where the treating chemistry is dispensed as part of the wash liquid. Recently, dispensing systems are being placed with clothes dryers where it is not possible to dispense the treating chemistry as part of a wash liquid.

SUMMARY OF THE INVENTION

The invention relates to a method of operating a laundry treating appliance by introducing into the treating chamber, an efficacious dose of treating chemistry at a non-deleterious concentration based on the moisture content of the laundry for a selected cycle of operation.

DESCRIPTION OF EMBODIMENTS OF THE INVENTION

Figure 1:
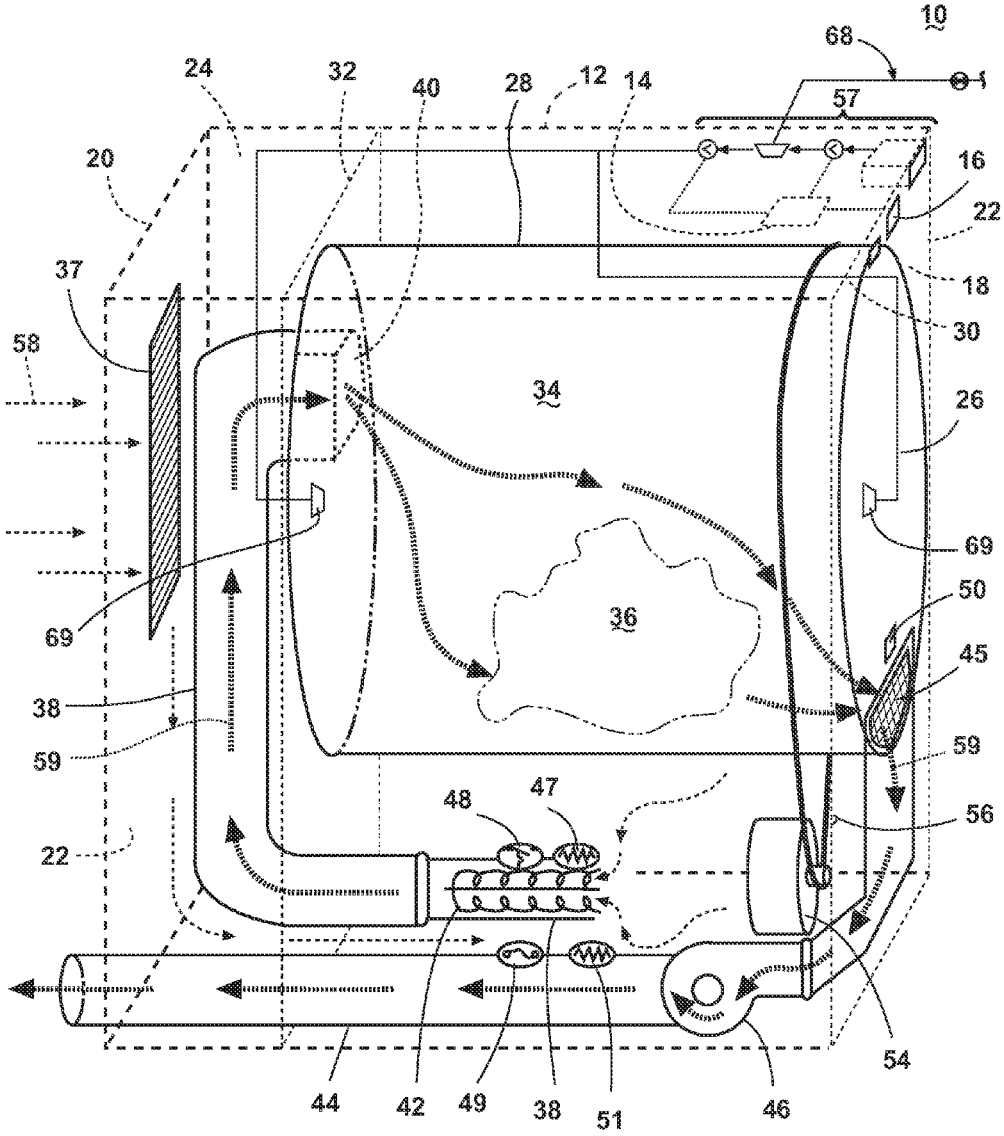
FIG. 1 is a schematic perspective view of a laundry treating appliance in the form of a clothes dryer according to an embodiment of the invention.

FIG. 1 is a schematic view of a laundry treating appliance 10 in the form of a clothes dryer 10 that may be controlled according to one embodiment of the invention. The clothes dryer 10 described herein shares many features of a traditional automatic clothes dryer, which will not be described in detail except as necessary for a complete understanding of the invention.

As illustrated in FIG. 1, the clothes dryer 10 may include a cabinet 12 in which is provided a controller 14 that may receive input from a user through a user interface 16 for selecting a cycle of operation and controlling the operation of the clothes dryer 10 to implement the selected cycle of operation.

The cabinet 12 may be defined by a front wall 18, a rear wall 20, and a pair of side walls 22 supporting a top wall 24. A chassis may be provided with the walls being panels mounted to the chassis. A door 26 may be hingedly mounted to the front wall 18 and may be selectively movable between opened and closed positions to close an opening in the front wall 18, which provides access to the interior of the cabinet 12.

A rotatable drum 28 may be disposed within the interior of the cabinet 12 between opposing stationary rear and front bulkheads 30, 32, which collectively define a treating chamber 34, for treating laundry 36, having an open face that may be selectively closed by the door 26. The treating chamber 34 is not fluidly coupled to a drain.

Examples of laundry include, but are not limited to, a hat, a scarf, a glove, a sweater, a blouse, a shirt, a pair of shorts, a dress, a sock, a pair of pants, a shoe, an undergarment, and a jacket. Furthermore, textile fabrics in other products, such as draperies, sheets, towels, pillows, and stuffed fabric articles (e.g., toys), may be dried in the clothes dryer 10.

The drum 28 may include at least one lifter (not shown). In most dryers, there may be multiple lifters. The lifters may be located along the inner surface of the drum 28 defining an interior circumference of the drum 28. The lifters may facilitate movement of the laundry 36 within the drum 28 as the drum 28 rotates.

The drum 28 may be operably coupled with a motor 54 to selectively rotate the drum 28 during a drying cycle. The coupling of the motor 54 to the drum 28 may be direct or indirect. As illustrated, an indirect coupling may include a belt 56 coupling an output shaft of the motor 54 to a wheel/pulley on the drum 28. A direct coupling may include the output shaft of the motor 54 coupled to a hub of the drum 28.

An air system may be provided to the clothes dryer 10. The air system supplies air to the treating chamber 34 and exhausts air from the treating chamber 34. The supplied air may be heated or not. The air system may have an air supply portion that may form, in part, a supply conduit 38, which has one end open to ambient air via a rear vent 37 and another end fluidly coupled to an inlet grill 40, which may be in fluid communication with the treating chamber 34. A heating element 42 may lie within the supply conduit 38 and may be operably coupled to and controlled by the controller 14. If the heating element 42 is turned on, the supplied air will be heated prior to entering the drum 28.

The air system may further include an air exhaust portion that may be formed in part by an exhaust conduit 44. A lint trap 45 may be provided as the inlet from the treating chamber 34 to the exhaust conduit 44. A blower 46 may be fluidly coupled to the exhaust conduit. The blower 46 may be operably coupled to and controlled by the controller 14. Operation of the blower 46 draws air into the treating chamber 34 as well as exhausts air from the treating chamber 34 through the exhaust conduit 44. The exhaust conduit 44 may be fluidly coupled with a household exhaust duct or exhausting the air from the treating chamber 34 to the outside the clothes dryer 10.

The air system may further include various sensors and other components, such as a thermistor 47 and a thermostat 48, which may be coupled to the supply conduit 38 in which the heating element 42 may be positioned. The thermistor 47 and the thermostat 48 may be operably coupled to each other. Alternatively, the thermistor 47 may be coupled to the supply conduit 38 at or near to the inlet grill 40. Regardless of its location, the thermistor 47 may be used to aid in determining the inlet temperature. A thermistor 51 and thermal fuse 49 may be coupled to the exhaust conduit 44, with the thermistor 51 being used to determine the outlet air temperature.

A moisture sensor 50 may be positioned in the interior of the treating chamber 34 to monitor the amount of moisture of the laundry in the treating chamber 34. One example of a moisture sensor 50 is a conductivity strip. The moisture sensor 50 may be operably coupled to the controller 14 such that the controller 14 receives output from the moisture sensor 50. The moisture sensor 50 may be mounted at any location in the interior of the dispensing dryer 10 such that the moisture sensor 50 may be able to accurately sense the moisture content of the laundry. For example, the moisture sensor 50 may be coupled to one of the bulkheads 30, 32 of the drying chamber 34 by any suitable means.

A dispensing system 57 may be provided to the clothes dryer 10 to dispense one or more treating chemistries to the treating chamber 34 according to a cycle of operation. As illustrated, the dispensing system 57 may be located in the interior of the cabinet 12 although other locations are also possible. The dispensing system 57 may be fluidly coupled to a water supply 68. The dispensing system 57 may be further coupled to the treating chamber 34 through a pair of nozzles 69.

Figure 2:
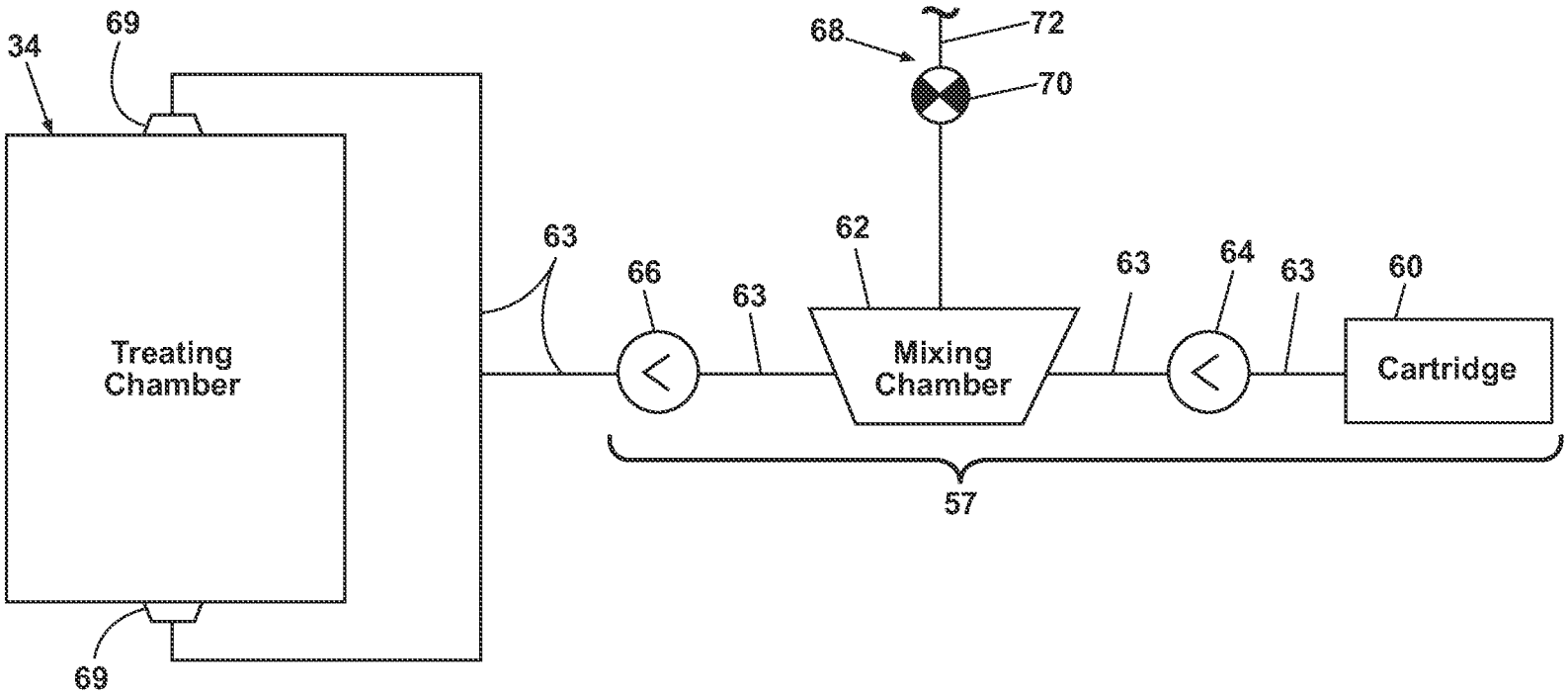
FIG. 2 is a schematic view of a dispensing system for the clothes dryer of FIG. 1.

Referring to FIG. 2, the details of the dispensing system 57 will be described. The dispensing system 57 may include a reservoir 60, which may be a cartridge, for a treating chemistry that is releasably coupled to the dispensing system 57, which dispenses the treating chemistry from the reservoir 60 to the treating chamber 34.

The treating chemistry may be any type of aid for treating laundry, and non-limiting examples include, but are not limited to, fabric softeners, sanitizers, de-wrinklers, and chemicals for imparting desired properties to the laundry, including stain resistance, fragrance (e.g., perfumes), insect repellency, and UV protection.

The reservoir 60 may include one or more cartridges configured to store one or more treating chemistries in the interior of cartridges. A suitable cartridge system may be found in U.S. application Ser. No. 12/165,712, which published as US 2010/0000022A1, which is incorporated by reference in its entirety. A mixing chamber 62 may be provided to couple the reservoir 60 to the treating chamber 34 through a supply conduit 63. Pumps such as a metering pump 64 and delivery pump 66 may be provided to the dispensing system 57 to selectively supply a treating chemistry and/or liquid to the treating chamber 34 according to a cycle of operation.

The water supply 68 may be fluidly coupled to the mixing chamber 62 to provide water from the water source to the mixing chamber 62. The water supply 68 may include an inlet valve 70 and a water supply conduit 72. It is noted that, instead of water, a different treating chemistry may be provided from the exterior of the clothes dryer 10 to the mixing chamber 62.

One or more nozzles 69 may couple the treating chamber 34 to the supply conduit 63. As illustrated, nozzles 69 are provided to the front and rear of the treating chamber 34 to provide the treating chemistry or liquid to the interior of the treating chamber 34 although other configurations are also possible.

Figure 3:
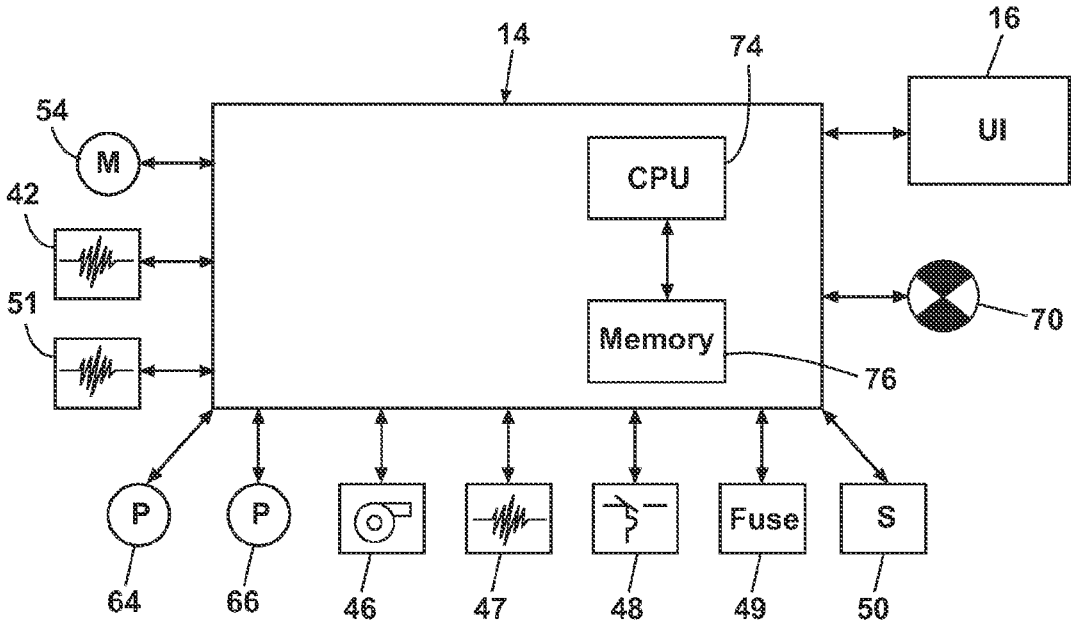
FIG. 3 is a schematic view of a controller of the clothes dryer in FIG. 1.

FIG. 3 is a schematic view of the controller 14 coupled to the various components of the dryer 10. The controller 14 may be communicably coupled to components of the clothes dryer 10 such as the heating element 42, blower 46, thermistor 47, thermostat 48, thermal fuse 49, thermistor 51, motor 54, inlet valve 70, and pumps 64, 66 to either control these components and/or receive their input for use in controlling the components. The controller 14 is also operably coupled to the user interface 16 to receive input from the user through the user interface 16 for the implementation of the drying cycle and provide the user with information regarding the drying cycle.

The user interface 16 may be provided having operational controls such as dials, lights, knobs, levers, buttons, switches, and displays enabling the user to input commands to a controller 14 and receive information about a drying cycle from components in the clothes dryer 10 or via input by the user through the user interface 16. The user may enter many different types of information, including, without limitation, cycle selection and cycle parameters, such as cycle options. Any suitable cycle may be used. Non-limiting examples include, Casual, Delicate, Super Delicate, Heavy Duty, Normal Dry, Damp Dry, Sanitize, Quick Dry, Timed Dry, and Jeans.

The controller 14 may implement a drying cycle selected by the user according to any options selected by the user and provide related information to the user. The controller 14 may also comprise a central processing unit (CPU) 74 and an associated memory 76 where various drying cycles and associated data, such as look-up tables, may be stored. One or more software applications, such as an arrangement of executable commands/instructions may be stored in the memory and executed by the CPU 74 to implement the one or more drying cycles.

In general, the controller 14 will effect a cycle of operation to effect a treating of the laundry in the treating chamber 34, which may or may not include drying. The controller 14 may actuate the blower 46 to draw air into the supply conduit 38 through the rear vent 37 when air flow is needed for a selected treating cycle. The controller 14 may activate the heating element 42 to heat the inlet air flow as it passes over the heating element 42, with the heated air being supplied to the treating chamber 34. The thermistor 47 may sense the temperature of inlet air that passes through the supply conduit 38 and send to the controller 14, a signal indicative of the sensed temperature. The heated air may be in contact with a laundry load 36 as it passes through the treating chamber 34 on its way to the exhaust conduit 44 to effect a moisture removal of the laundry. The air may exit the treating chamber 34, and flow through blower 46 and the exhaust conduit 44 to the outside the clothes dryer 10. The controller 14 continues the cycle of operation until completed. If the cycle of operation includes drying, the controller 14 determines when the laundry is dry. The determination of a "dry" load may be made in different ways, but is often based on the moisture content of the laundry, which is typically set by the user based on the selected cycle, an option to the selected cycle, or a user-defined preference.

During a cycle of operation, one or more treating chemistries may be provided in the interior of the treating chamber 34 by the dispensing system 57 as actuated by the controller 14. To dispense the treating chemistry, the metering pump 64 is actuated by the controller 14 to pump a predetermined quantity of the treating chemistry stored in the cartridge 60 to the mixing chamber 62, which may be provided as a single charge, multiple charges, or at a predetermined rate, for example. The treating chemistry may be in a form of gas, liquid, solid or any combination thereof, and may have any chemical composition enabling refreshment, disinfection, whitening, brightening, increased softness, reduced odor, reduced wrinkling, stain repellency or any other desired treatment of the laundry. Water is one example of a suitable treating chemistry. Other non-limiting examples of suitable treating chemistries are chromophore chemistry, softening chemistry, and stain-repellency chemistry. In all cases, the treating chemistries may be composed of a single chemical, a mixture of chemicals, or a solution of water and one or more chemicals.

Depending on a cycle of operation, liquid such as water or a different treating chemistry may be provided to the mixing chamber 62, irrespective of the presence of a treating chemistry. For example, water may be mixed with the treating chemistry in the mixing chamber 62 before a mixture of the treating chemistry and water is pumped to the treating chamber 34 by the delivery pump 66 through the supply conduit 63. The water may be also supplied to the interior of the treating chamber 66 according to a cycle of operation. It is contemplated that the mixing chamber 62 may be used to reduce the concentration of the treating chemistry because many treating chemistries are provided in the cartridge at concentrations that are too high to directly apply to the laundry, but which saves shipping costs and provides a more convenient size for the cartridge. The addition of water with the treating chemistry provides for reducing the concentration to a non-deleterious concentration. The nozzles 69 may be a rigid nozzle or may be a flexible nozzle constructed of a material such as silicone, or polyethylene. It should be readily understood that the type of nozzles 69 and/or the number of nozzles 69 may be changed. For example, there may be any number of nozzles 69 positioned to direct the treating chemistry into the treating chamber 34. Types of nozzles 69 that may be used, include, but are not limited to, nozzles, misters, nebulizers, steamers, or any other outlet that produces a spray. The nozzles 69 may dispense the treating chemistry and other fluids as a continuous stream, a mist, an intermittent stream, or various other spray patterns.

Different types of fabrics have different absorption rates corresponding to different surface energies of the fibers or affinity to liquids. For example, cotton is very hydrophilic and has a high affinity to water, while polyester is very hydrophobic and has a lower affinity to water compared to cotton. Properties of fabrics that affect the absorption rate may include the type of fiber, type of weave, coatings on the fiber/fabric, thread count of the fabric, and the thickness of the fabric. If a water based liquid treating chemistry is dispensed directly on a mixed load with the different garments having different affinities to water, the liquid treating chemistry may not be uniformly distributed on the load since the liquid treating chemistry will be more strongly attracted to hydrophilic surfaces.

A chromophore is a chemical group in a compound that is responsible for the color of the compound by selectively absorbing light at particular wavelengths. Non-limiting examples of molecules that contain a chromophore group are dyes and polymeric colorants. One type of polymeric colorants consist of a polymer backbone attached to a chromophore; non-limiting examples of the polymeric backbone include poly(ethylene oxide), poly(ethylene oxide)-diacetate, poly(vinylamine), and poly(alkyl-vinylamine).

When deposited on a fabric, a whitening chromophore selectively absorbs regions of the visible light spectrum to a greater degree when the fabric is excited by visible light and reflects back a whiter color compared to the fabric's original color. For example, when a whitening chromophore is deposited on a white fabric that has a yellowish or reddish tinge, a whitening chromophore selectively absorbs a greater amount in the yellow and red regions of the visible light spectrum when the fabric is excited by visible light and hence reflects back a greater percentage of light in the blue region of the visible light spectrum, thus, making the fabric look whiter compared to it's original color. If a liquid treating chemistry containing a chromophore is non-uniformly distributed onto a load of laundry, the load will not have a uniform color appearance after drying. Higher concentrations of such a whitening chromophore may appear as a blue discoloration on the fabric.

For the reasons cited above, it may be important that treating chemistries are dispensed in a manner such that they are uniformly absorbed by the laundry to a dose that is desired. This may involve dispensing at a specific concentration that is not deletrious to the laundry. Such a method may also involve determining the dose of treating chemistry required and only dispensing up to that determined dose.

The previously described clothes dryer 10 provides the structure necessary for the implementation of the method of the invention. Embodiments of the method will now be described in terms of the operation of the clothes dryer 10. The embodiments of the method function to ensure that a liquid treating chemistry is provided at a proper concentration on to a load of laundry until a proper dose has been dispensed.

Figure 4:
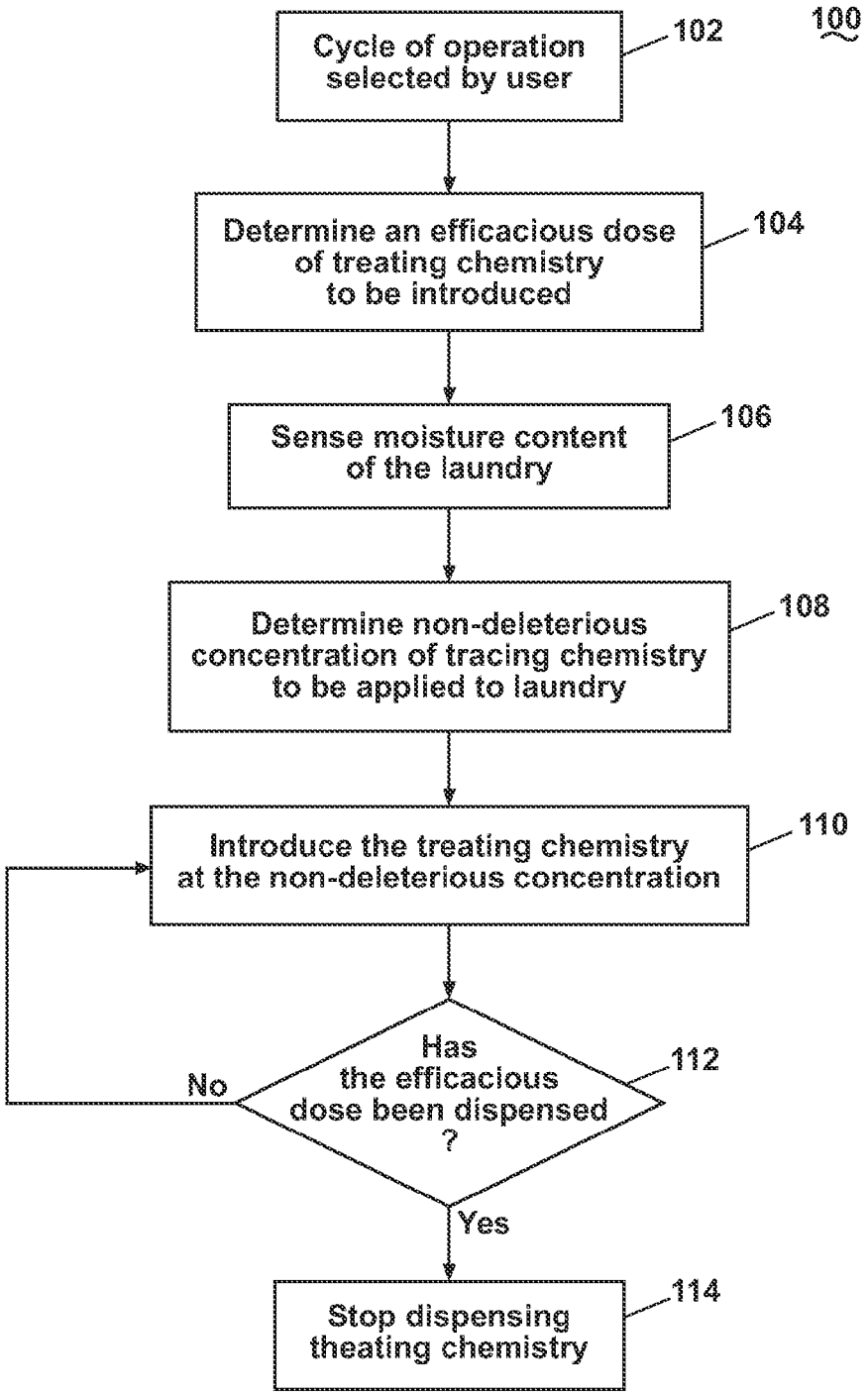
FIG. 4 is a flow-chart depicting a method of dispensing a treating chemistry according to one embodiment of the invention.

FIG. 4 is a flow-chart depicting a method 100 of dispensing a treating chemistry according to one embodiment of the invention. The method 100 may be carried out by the controller 14 using information inputted by the user via the user interface 16 and from the sensors 50, 47, and 51. The method 100 described herein may be applicable to a refreshing cycle and a chemistry-enhanced drying cycle. The sequence of steps depicted is for illustrative purposes only and is not meant to limit the method 100 in any way as it is understood that the steps may proceed in a different logical order, additional or intervening steps may be included, or described steps may be divided into multiple steps, without detracting from the invention.

The method 100 begins with a user selection phase in which a user may select a cycle of operation at 102. Non-limiting examples of cycles of operation include a normal drying cycle, a refreshing cycle, and a chemistry-enhanced drying cycle. A normal drying cycle generally includes drying the load without the application of a treating chemistry. A refreshing cycle generally includes applying a treating chemistry to a dry or relatively dry load and thereafter drying the load. A chemistry-enhanced drying cycle generally includes applying a treating chemistry to wet load and drying the load.

Incorporated with the user selection of the cycle of operation at 102, the user may also select the level of treating chemistry dispensed during the cycle of operation. Examples of treating chemistry levels include none, extra-low, low, medium, high, and extra-high. The user may also optionally select other cycle modifiers at 102, such as a load amount, a load color, and/or a fabric type. Examples of load amounts are extra-small, small, medium, large, or extra-large. Examples of load colors are whites and colors. Examples of fabric types are cotton, silk, polyester, delicates, permanent press, and heavy duty. All such selections may be performed via the user interface 16 of the clothes dryer 10. The user's selections may be communicated to the controller 14, and the cycle of operation may commence.

From the user selections at 102 an efficacious dose of treating chemistry to be introduced in to treating chamber 34 is determined at 104 by the controller 14. The efficacious dose may be determined based on user selections of treating chemistry levels and load levels. As used herein, efficacious dose is used to describe the amount of treating chemistry that is applied to the laundry load to obtain the degree of treating desired by the user. In most cases, the parameters impacting a determination of an efficacious dose are the size of the load, the type of fabrics in the load, and the degree of treating desired by the user. These parameters may be supplied by the user as part of the cycle selection as previously described. In combination with or as an alternative to user input, any or all of these parameters may be determined by the controller 14 by reference to default values, which may be stored in the memory 76 of the controller 14. The default values may be independent of a function of the other parameters. The default values may be modified over time based on the user's usage history. The controller 14 may, for example, access a look-up table stored on memory of efficacious doses stored in memory and use a laundry load size estimate and a dispense level selection to look-up the efficacious dose. For example, for a medium size load, of approximately 3.5 kg weight, and extra-low treating chemistry level, of 0.30% treating chemistry to fabric by weight, the efficacious dose may be 10.5 g of treating chemistry. As a further example for a large size load, of approximately 5 kg weight, and a high treating chemistry level, of 0.7% treating chemistry to fabric by weight, the efficacious dose may be 35 g of treating chemistry. The treating chemistry to fabric by weight may be any level. A non-limiting example may be treating chemistry to fabric by weight levels of 0, 0.3%, 0.4%, 0.5%, 0.6%, and 0.7% for selected treating chemistry levels of none, extra-low, low, medium, high and extra-high, respectively.

Next, the moisture content of the laundry may be detected at 106 using the moisture sensor 50. The moisture content may be used by the controller 14 to determine a non-deleterious concentration of the treating chemistry to be applied to the laundry at 108. Such a determination may be conducted by the controller 14 looking up a non-deleterious concentration of the treating chemistry from a look-up table stored in the memory 76. A non-deleterious concentration, as used in this description, is a concentration that does not provide a flawed appearance of the laundry, such as a concentration of a brightener that would leave visibly noticeable areas of differing brightness, as well as a permanent discoloration or structural change to the fabric.

Once the non-deleterious concentration is determined at 108, the treating chemistry is introduced at the non-deleterious concentration on the laundry at 110 in the treating chamber 34. While the treating chemistry is introduced in to the treating chamber 34, the controller 14 determines if the efficacious dose has been dispensed at 112. If the efficacious dose has not been dispensed, then the controller 14 continues to introduce the treating chemistry at the non-deleterious concentration on to the laundry. If, however, the controller 14 determines that the efficacious dose has been dispensed at 112, then the dispensing of treating chemistry is stopped at 114.

In the method of dispensing a treating chemistry 100, there may be an optional step where the clothes dryer 10 determines a load size prior to determining an efficacious dose. Such a load determination may be by known means such as motor torque measurement or load mass estimation (LME) techniques that use supply air temperature as measured by sensors 74 such as a supply air temperature sensor and an exhaust air temperature sensor near the beginning of the drying cycle, such as during the first two minutes of the drying cycle. Such LME techniques may determine the load size by comparing the slopes of the supply and exhaust air temperatures. To determine the efficacious dose at 104 the controller may optionally override user input at 102 with automatic laundry load size detection by methods such as LME.

As a further option, a pre-treating wetting chemistry may be dispensed prior to or after sensing the moisture at 106 to make the laundry surface more uniform from the standpoint of affinity to water. Such pre-treating chemistries may include various surfactants or wetting agents. The purpose of a pre-treating dispense may be to improve the uniformity of the absorption during introducing the treating chemistry at the non-deleterious concentration at 110. Such pre-treating chemistries may be dispensed via the nozzles 69 on to the laundry in the treating chamber 34. The pre-treating chemistry may further be dispensed via the nozzles 69 while tumbling the laundry load by rotating the drum 28. As a further option, heated or unheated air may be introduced into the treating chamber 34 during tumbling to evaporate any excess pre-wetting chemistry. A more detailed description of pre-treating fabric may be found in U.S. application Ser. No. 12/713,489, filed on Feb. 26, 2010, which is incorporated herein by reference in its entirety.

During the treating chemistry dispensing step at 110, the drum 28 may be rotated to tumble the clothes in the treating chamber 34 to promote a more uniform distribution of treating chemistry. Additionally, heated or unheated air may be introduced into the treating chamber 34 during tumbling to provide additional turbulence for the purpose of a more even distribution of treating chemistry on to the laundry. The treating chemistry may be any known type of treating chemistry, including chromophore chemistry, a stain-repellency chemistry, anti-wrinkle agents, softeners, perfumes, or combinations thereof. The reservoir 60 may hold treating chemistry of a specific concentration greater than the non-deleterious concentration. For example, the reservoir may contain water and treating chemistry mixture of 8% treating chemistry by weight. The introduction at a non-deleterious concentration may be accomplished by the controller 14 appropriately controlling the chemistry metering pump 64 and the water supply inlet valve 70 to produce the required concentration within the mixing chamber 62 to be delivered by the nozzles 69. For example, if the reservoir 60 contains an 8% concentration treating chemistry mixture and the non-deleterious concentration is determined to be 3%, then the water supply inlet valve 70 and the treating chemistry metering pump 64 may be controlled by the controller 14 to allow a flow rate to water and treating chemistry mixture contained in the reservoir 60 to achieve a 3% concentration in the mixing chamber 62. Continuing with this example, if the efficacious dose is determined to be 24 g of treating chemistry, then the treating chemistry mixture in the reservoir 60 may be dispensed at a rate of 100 cc/minute for 3 minutes, for a total of 24 g of chemistry while flowing water at a rate of 167 cc/minute for the same 3 minutes. As such, the total efficacious dose of 24 g of treating chemistry is delivered at a non-deleterious concentration of 3%.

The chemistry metering pump 64 and water supply inlet valve 70 may be selectively controlled to permit their setting to achieve a continuous flow there through. In such a case, the controller 14 controls the metering pump 64 and supply inlet valve 70 to generate a continuous flow of treating chemistry at a non-deleterious concentration. Alternatively, the chemistry metering pump 64 and water supply inlet valve 70 may only have off and on controls, without variable settings. In such a case, any variety of time division techniques may be used by the controller 14 to control the relative flow of fluid through the chemistry metering pump 64 and the water supply inlet valve 70. For example, pulse width techniques may be used where the duty cycle of a pulse for the chemistry metering pump 64 and the water supply inlet valve 70 are set to provide the appropriate concentration of the treating chemistry delivered via the dispenser 62. A further possibility is that one of the chemistry metering pump 64 and water supply inlet valve 70 may have variable flow control and the other does not. In this case, one valve may be controlled by the controller 14 in a continuous flow manner and the other may be controlled using time division techniques. The exact means of controlling the chemistry metering pump 64 and the water supply inlet valve 70 does not detract from the method for dispensing a treating chemistry 100.

Figure 5:
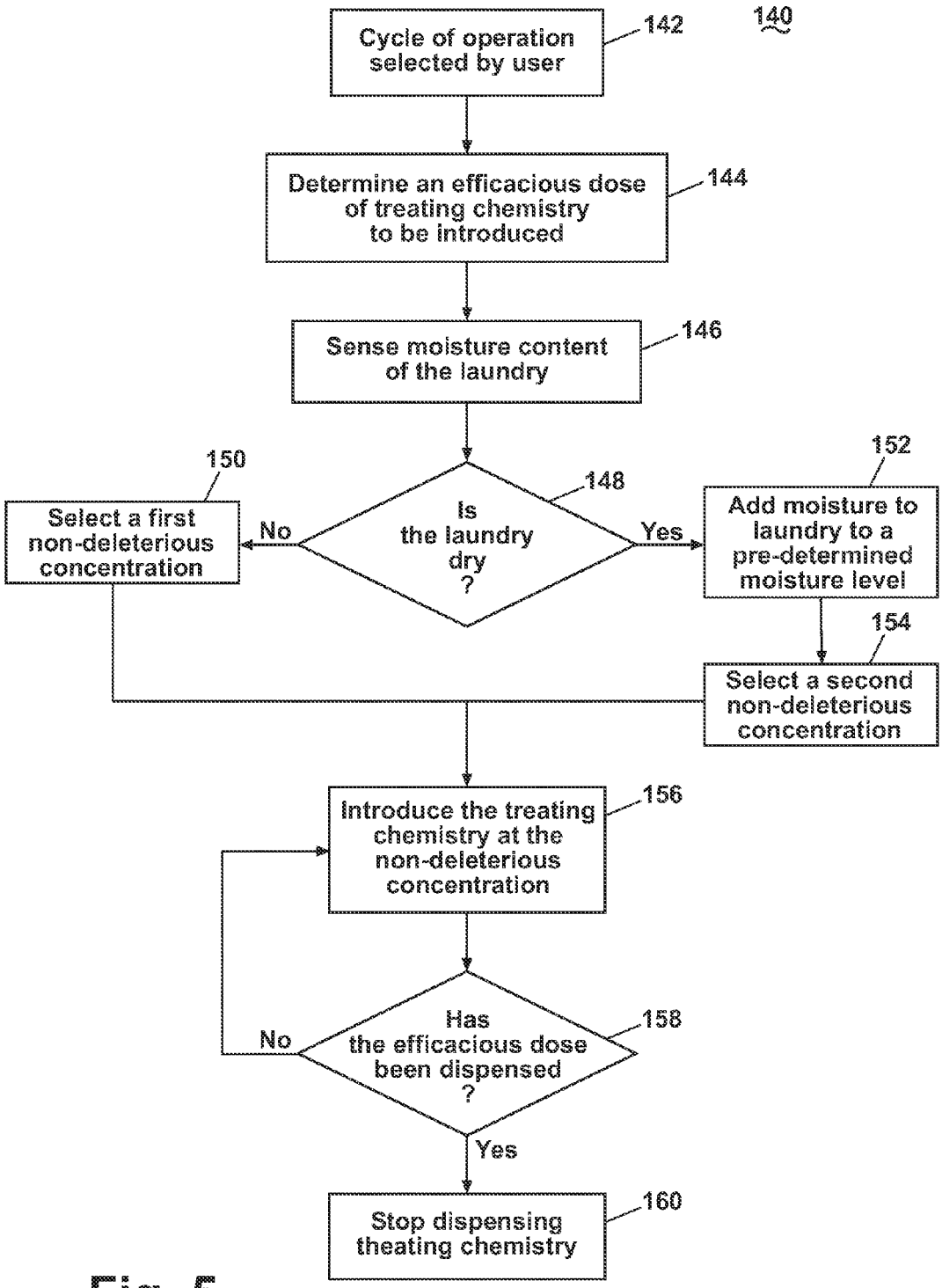
FIG. 5 is a flow diagram depicting a method of dispensing a treating chemistry according to another embodiment of the invention.

When the laundry is considered dry, it may be necessary to add some moisture to the laundry prior to dispensing treating chemistry to ensure a uniform treatment on to laundry of various types and various affinities to water (i.e. various levels of hydrophobic or hydrophilic). Such dry laundry loads may be operated on by the clothes dryer 10 for a refresh or revitalize cycle of operation. FIG. 5 is a flow diagram depicting a method of dispensing a treating chemistry according to another embodiment of the invention with an additional step of adding moisture to a predetermined level when the laundry is considered dry.

As in the case of method 100, method 140 begins with a user selection phase in which a user may select a cycle of operation at 142 using the user interface 16. Such selection may include selection of laundry load size. Next an efficacious dose of treating chemistry may be determined at 144 by the controller 14 using the methods described in conjunction with FIG. 4. The moisture of the laundry load is next sensed at 146 with the moisture sensor 50. From the sensed moisture information from the moisture sensor 50 at 146, it is determined if the laundry load is dry at 148 by the controller 14. If the laundry is not dry, the controller 14 may select a first non-deleterious concentration of treating chemistry at 150. If the laundry is dry, then the clothes dryer 10 may run a re-fresh or revitalize cycle of operation and prior to adding treating chemistry, moisture may be added to the laundry to a predetermined level at 152. For a re-fresh or re-vitalize cycle of operation, the controller 14 may select a second non-deleterious concentration of treating chemistry at 154. The non-deleterious concentration of treating chemistry may then be introduced to the laundry via the nozzles 69 at 156 using the control methods described above in conjunction with method 100 of FIG. 4. The controller 14 monitors if the efficacious dose has been dispensed while the treating chemistry is sprayed on the laundry at the non-deleterious concentration at 158. If the efficacious dose has not been dispensed, then the treating chemistry continues to be dispensed on the laundry. However, if the efficacious dose has been dispensed, then the dispensing is stopped at 160 by the controller 14.

In this embodiment, there are two non-deleterious concentrations, one for a wet load and one for a dry load. Therefore, for a fixed treating chemistry concentration mixture in the reservoir 60, there may be two different relative release rates of treating chemistry mixture and water by the controller 14 by controlling the chemistry metering pump 64 and the water supply inlet valve 70, respectively. The first non-deleterious concentration may be greater than the second non-deleterious concentration. In other words, a higher concentration of treating chemistry may be dispensed on to a wet load compared to a dry load.

A load may be considered dry at step 148 if the moisture content of the load is at 10% or less. A load may be considered wet if the moisture content is greater than 30%. Dry loads tend to have highly disparate affinities to water depending on attributes of the fabrics in the laundry load and wetting the laundry can reduce the level of disparity in the affinity to water for various types of fabric in the laundry load. Therefore, when the load is considered dry, water may be added to the laundry load to a pre-determined level that promotes uniform distribution of the treating chemistry. The predetermined level may, for example, be 10% moisture. The moisture may be added by the controller 14 by affecting a flow of water from the water supply line 68 by opening the water supply inlet valve 70 until the predetermined level of moisture is dispensed on to the laundry. Optionally, after the desired moisture content is reached at 152, the drum 28 may be rotated to tumble the load at to ensure uniform wetting on the laundry prior to introducing the treating chemistry at the non-deleterious concentration at 156. As in the method 100 of FIG. 4, in method 140 the introducing the treating chemistry at 156 may be done while rotating the drum 28 and while heated or unheated air is introduced in to the treating chamber 34 to provide a more uniform distribution of treating chemistry on to the laundry.

If the moisture in the laundry indicates a partially wet load (i.e. moisture content between 10 and 30%), the load may be treated as a dry load. Alternatively, a partially wet load may be treated as a dry load from the standpoint of selecting the second non-deleterious concentration at 154 and as a wet load from the standpoint of not adding any additional moisture prior to introducing the non-deleterious concentration of treating chemistry at 156.

It is notable that the embodiments of the invention may be used with a clothes dryer 10 that does not have a liquid drain system, such as is found in a washing machine or a revitalizing machine. In the latter types of laundry treating appliances, if an excess amount of liquid treating chemistry is dispensed, it is removed from the treating chamber by the liquid drain system. For a clothes dryer 10 without a liquid drain system, excess treating chemistry may pool or puddle in the treating chamber. This may accelerate the normal wear and tear of the structure forming the treating chamber. Furthermore, a current or subsequent load of laundry may absorb some of the excess liquid treating chemistry, resulting in excessively long cycle times and or an undesired treatment, including spotting and over-treatment. Therefore, for the clothes dryer 10 without a liquid drain system, it is especially important that only the efficacious dose is dispensed without excess, so that subsequent loads are not effected by excess treating chemistry in the clothes dryer 10. The methods 100 and 140 may prevent dispensing more than the efficacious dose.

A clothes dryer using the methods 100 and 140 may also distribute a treating chemistry onto a load of laundry at a non-deleterious treating chemistry concentration. Doing so prevents damage to the laundry and non-uniform distribution of treating chemistry on the laundry. The determined non-deleterious concentration may be a function of the moisture content of the laundry. For a dry load of laundry, the load may need to be pre-wetted before dispensing the treating chemistry to ensure even distribution over a load consisting of various fabric types and therefore various levels of absorption.

While the invention has been specifically described in connection with certain specific embodiments thereof, it is to be understood that this is by way of illustration and not of limitation, and the scope of the appended claims should be construed as broadly as the prior art will permit. It should also be noted that all elements of all of the claims may be combined with each other in any possible combination, even if the combinations have not been expressly claimed.

What is claimed is:

1. A method of operating a laundry treating appliance having multiple controllable components including a laundry treating chamber for receiving laundry to be treated, a treating chemistry dispensing system, and a controller controlling the multiple controllable components according to one or more treating cycles of operation that may be selected by a user, the method comprising:

determining a selection of a cycle of operation requiring introduction of a treating chemistry to be dispensed by the treating chemistry dispensing system;

determining an efficacious dose of treating chemistry to be introduced into the treating chamber based on a selected cycle of operation;

determining a moisture content of the laundry in the treating chamber and providing the determined moisture content to the controller as an output;

determining, by the controller, a non-deleterious concentration of the treating chemistry to be applied to the laundry in the treating chamber based on at least the moisture content output to the controller;

introducing the treating chemistry at the non-deleterious concentration to the laundry treating chamber as part of the cycle of operation; and wherein the treating chemistry is introduced at the determined non-deleterious concentration to uniformly distribute the determined efficacious dose of treating chemistry onto the laundry.

2. The method of claim 1 wherein the introduction of the treating chemistry at the non-deleterious concentration is continued until the efficacious dose is dispensed into the treating chamber.

3. The method of claim 1 wherein the determining a non-deleterious concentration comprises determining a non-deleterious concentration threshold.

4. The method of claim 3 wherein the introducing the treating chemistry at the non-deleterious concentration comprises introducing treating chemistry at a concentration satisfying the non-deleterious concentration threshold.

5. The method of claim 4 wherein satisfying the non-deleterious concentration threshold comprises the concentration of the treating chemistry being less than the non-deleterious concentration threshold.

6. The method of claim 1 further comprising dispensing at least a portion of the efficacious dose of treating chemistry and diluting the portion to the non-deleterious concentration.

7. The method of claim 6 wherein the introduction of the non-deleterious concentration of treating chemistry into the treating chamber comprises applying the diluted portion onto the laundry in the treating chamber.

8. The method of claim 1 wherein determining an efficacious dose of treating chemistry comprises at least one of: an input from the user indicative of a degree of treating effect, load size of the laundry, or fabric type of the laundry.

9. The method of claim 1 wherein determining the moisture content comprises: setting a predetermined moisture content based on the selected cycle of operation, executing a moisture estimation routine by the controller, sensing a humidity in the treating chamber, or sensing a conductivity of the laundry in the treating chamber.

10. The method of claim 1 further comprising setting a predetermined moisture content threshold for the treating chemistry.

11. The method of claim 10 further comprising wetting the laundry in the treating chamber until the moisture content of the laundry satisfies the predetermined moisture content threshold prior to introduction of the treating chemistry into the treating chamber.

12. The method of claim 11 wherein the determining a non-deleterious concentration of the treating chemistry comprises setting a predetermined non-deleterious concentration for the predetermined moisture content threshold.

13. The method of claim 1 wherein the determining a non-deleterious concentration of treating chemistry comprises establishing multiple corresponding pairs of moisture content threshold values and non-deleterious concentrations of the treating chemistry, selecting one of the moisture content threshold values based on the determined moisture content and selecting the non-deleterious concentration corresponding to the selected one of the moisture content threshold values.

14. The method of claim 1 further comprising reducing the moisture content of the laundry after application of the treating chemistry.

15. The method of claim 14 wherein the reducing the moisture content comprises rotating the treating chamber.

16. The method of claim 15 further comprising supplying air to the treating chamber while the treating chamber is rotated.

17. The method of claim 16 further comprising heating the air supplied to the treating chamber.

18. The method of claim 1 further comprising selecting a treating chemistry for dispensing based on the selected cycle of operation.

19. The method of claim 18 wherein determining the efficacious dose is based on the selected treating chemistry.

20. A method of operating a clothes dryer having multiple controllable components including a laundry treating chamber for receiving laundry to be treated, a treating chemistry dispensing system, and a controller controlling the multiple controllable components according to one or more treating cycles of operation that may be selected by a user, the method comprising:

determining a selection of a cycle of operation requiring introduction of a treating chemistry to be dispensed by the treating chemistry dispensing system;

determining an efficacious dose of treating chemistry to be introduced into the treating chamber based on a selected cycle of operation;

determining a moisture content of the laundry in the treating chamber and providing the determined moisture content to the controller as an output;

determining, by the controller, a non-deleterious concentration of the treating chemistry to be applied to the laundry in the treating chamber based on at least the moisture content output to the controller;

introducing the treating chemistry at the non-deleterious concentration to the laundry treating chamber as part of the cycle of operation; and wherein the treating chemistry is introduced at the determined non-deleterious concentration to uniformly distribute the determined efficacious dose of treating chemistry onto the laundry.

* * * * *